United States Patent [19]

Ferdinand et al.

[11] Patent Number: 4,466,675

[45] Date of Patent: Aug. 21, 1984

[54] KNOCK-DOWN DRAWER ASSEMBLY

[75] Inventors: Irwin J. Ferdinand, Glencoe; Richard Sylvan, Glenview; Michael Peterson, Evanston, all of Ill.

[73] Assignee: Hirsh Company, Skokie, Ill.

[21] Appl. No.: 435,344

[22] Filed: Oct. 19, 1982

[51] Int. Cl.[3] ..... A47B 88/00

[52] U.S. Cl. ..... 312/263; 312/330 R

[58] Field of Search ..... 312/108, 111, 263, 330; 403/337, 349, 358, 381, 403, 382, 231; 217/65

[56] References Cited

U.S. PATENT DOCUMENTS

| | | | |
|---|---|---|---|
| Re. 21,524 | 8/1940 | Gramelspacher | 217/65 |
| 1,083,865 | 1/1914 | Sloss | 403/231 |
| 1,290,743 | 1/1919 | Herpst et al. | |
| 1,352,002 | 9/1920 | Jones | |
| 1,468,786 | 9/1923 | Knechtel | 403/381 |
| 2,079,330 | 5/1937 | Norinsberg et al. | 217/12 R |
| 2,551,775 | 5/1951 | Von Canon | 217/65 |
| 2,701,174 | 2/1955 | Franks | |
| 2,801,895 | 8/1957 | Gass | |
| 2,862,640 | 12/1958 | Somavia | |
| 3,029,357 | 4/1962 | Williams | |
| 3,031,782 | 5/1962 | Frye | |
| 3,090,086 | 5/1963 | Fata | 403/381 |
| 3,193,886 | 7/1965 | Wenger et al. | 217/65 |
| 3,273,952 | 9/1966 | Himelreich et al. | |
| 3,282,635 | 11/1966 | Himelreich | |
| 3,316,460 | 4/1967 | Scoville | |
| 3,338,285 | 8/1967 | Jaster | |
| 3,379,483 | 4/1968 | Oldford | |
| 3,462,208 | 8/1969 | Black et al. | |
| 3,527,515 | 9/1970 | Grau et al. | |
| 3,542,447 | 11/1970 | Himelreich | |
| 3,554,627 | 1/1971 | Mock | |
| 3,639,027 | 2/1972 | Higdon, Jr. | |
| 3,687,512 | 8/1972 | Alston | |
| 3,696,233 | 10/1972 | Pulsifer | |
| 3,716,283 | 2/1973 | Little | |
| 3,738,726 | 6/1973 | Burst et al. | |
| 3,752,553 | 8/1973 | Bildahl et al. | |
| 3,759,600 | 9/1973 | MacDonald | |
| 3,846,003 | 11/1974 | Rockwell | |
| 3,895,733 | 7/1975 | Chambers | |
| 4,128,284 | 12/1978 | King | |
| 4,277,122 | 7/1981 | Bargiel | |
| 4,279,455 | 7/1981 | Santo | |

FOREIGN PATENT DOCUMENTS 2755527 12/1977 Fed. Rep. of Germany .

OTHER PUBLICATIONS

Sears Craftsman Brochure entitled "Drawers" and designated "F-354" (2 pages).

Sears Craftsman Brochure entitled "Drawer for Workbenches and Saw Stands" and designated "F-328-4" (4 pages).

U.S. patent application, Ser. No. 260,054 of Ferdinand et al., filed May 4, 1981.

*Primary Examiner*—William E. Lyddane

*Assistant Examiner*—Joseph Falk

*Attorney, Agent, or Firm*—Dressler, Goldsmith, Shore, Sutker & Milnamow, Ltd.

[57] ABSTRACT

A knock-down drawer assembly is provided with a front panel, a pair of side panels, a rear panel, and a bottom panel. The front, rear, and side panels are provided with channels for receiving the bottom panel. The front panel defines two generally vertical and parallel dovetail mortises on the inner face of the front panel. The opposing sides of each mortise taper inwardly at a constant angle along the vertical length of the mortise. Each of the side panels has a dovetail tenon on one end of the panel. The sides of each tenon taper inwardly along the vertical length of the tenon and each tenon is adapted to be received in a mortise of the front panel. A shoulder is provided on the rear end of each side panel for locating the rear panel along the length of the side panel relative to the front panel. Fastening means are provided for securing the side panels to the rear panel. The inner faces of the front, rear, and side panels are provided with inwardly projecting and concavely curved lips extending over the margins of the bottom panel. The interior vertical corners of the drawer assembly are constructed so that the interior angles at the corners are greater than 90°.

2 Claims, 7 Drawing Figures

FIG. 5
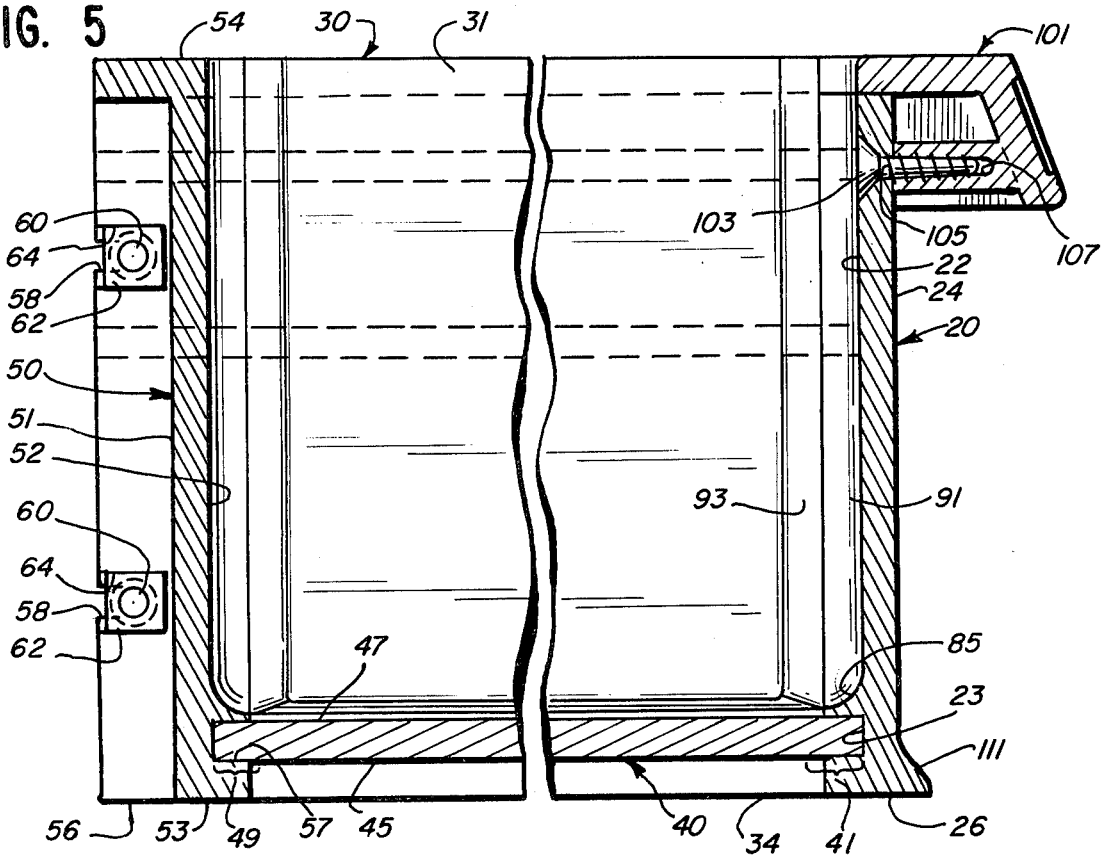
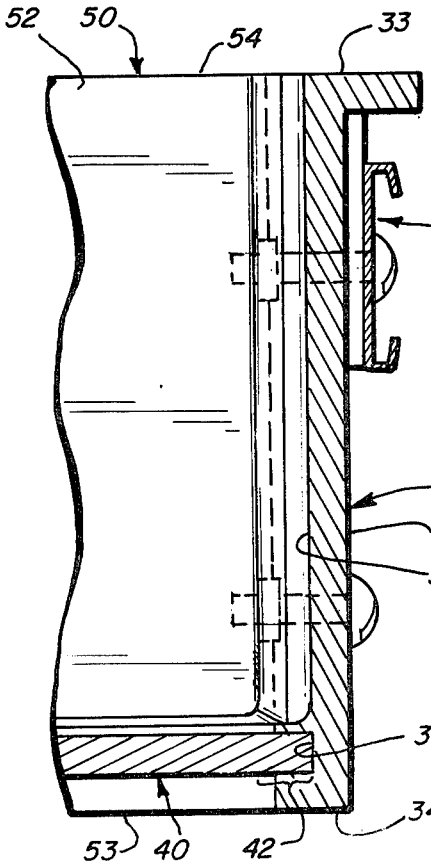
FIG. 6
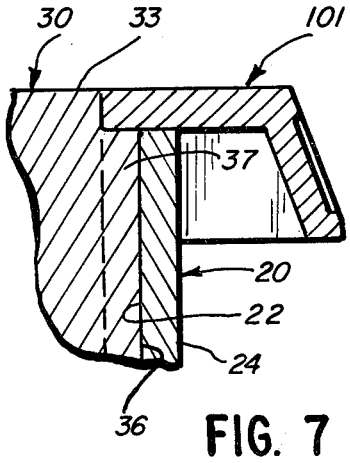
FIG. 7

KNOCK-DOWN DRAWER ASSEMBLY

TECHNICAL FIELD

This invention relates to drawer assemblies which are typically available to the user in a knocked-down condition and which may be readily assembled by the user.

BACKGROUND OF THE INVENTION

A wide variety of drawer assemblies have been available or proposed over the years. Many such drawer assemblies have been fabricated from wood or metal. However, over the last two decades, the use of synthetic materials has greatly increased. Manufacturers have realized that synthetic materials provide advantages in, inter alia, weight reduction, moldability, and cost savings. In addition, synthetic materials can be relatively easily fabricated to provide a modern, sleek-looking appearance.

Although drawers molded from synthetic materials are now common, it would be desirable to provide an improved drawer construction that will readily accommodate the manufacture of drawer assembly components from various materials, especially synthetic materials.

It would further be advantageous to provide such an improved drawer construction which could be assembled with a relatively small number of separate fastening devices.

In addition, it would be beneficial if such an improved drawer construction could be provided with a relatively smooth interior surface free of internal hardware, ribs, and right-angle corners which can collect dirt and which are hard to clean.

Also, it would be desirable to provide an improved drawer construction which could be assembled relatively easily and quickly by the user and which would include components that fit together in predetermined positions so as to require few, if any, manipulations to properly align the components.

SUMMARY OF THE INVENTION

A knock-down drawer assembly is provided with a front panel, a rear panel, a bottom panel, and two side panels. Each of the panels has an inner face and an outer face. Each of the panels except the bottom panel defines a channel on its inner face for receiving a margin of the bottom panel.

Mortise and tenon joints are provided for connecting the side panels to the front panel. In a preferred form of the invention, each mortise and tenon joint has a unique configuration wherein the joint tapers inwardly along the vertical length of the joint to limit the movement of the tenon relative to the mortise so as to locate the side panels at a predetermined vertical placement relative to the front panel.

Means are provided for securing each end of the rear panel to one of the side panels adjacent the rear end of the side panel.

In a preferred form of the invention, each side panel defines a rearwardly facing shoulder abutting an end margin of the rear panel to locate the rear panel along the length of the side panel relative to the front panel.

Further, in a preferred form of the invention, each end margin of the rear panel has a rearwardly projecting flange that is parallel to a rearward extension of one of the side panels and that is in face-to-face engagement with that side panel rearward extension.

The preferred embodiment of the invention also includes an inwardly projecting lip on each of the side, front, and rear panels. The lip defines a concave curvature on the inside of the drawer above the bottom panel.

In addition, the preferred form of the invention also defines a structure that eliminates right-angle corners on the inside vertical walls of the drawer. Specifically, each of the side, rear, and front panels is provided with a corner surface that matches a corner surface of an adjacent panel. Each corner surface of a panel defines an angle measured between the inner face of that panel and the corner surface of between 90° and 180°.

Numerous other advantages and features of the present invention will become readily apparent from the following detailed description of the invention and one embodiment thereof, from the claims, and from the accompanying drawings.

BRIEF DESCRIPTION OF THE DRAWINGS

In the accompanying drawings forming part of the specification, and in which like numerals are employed to designate like parts about throughout the same.

FIG. 5 is a greatly enlarged, fragmentary, cross-sectional view taken generally along the plane 5—5 in FIG. 2;

FIG. 6 is a greatly enlarged, fragmentary, cross-sectional view taken generally along the plane 6—6 in FIG. 2; and FIG. 7 is a greatly enlarged, fragmentary, cross-sectional view taken generally along the plane 7—7 in FIG. 2;

DESCRIPTION OF THE PREFERRED EMBODIMENT

Figure 1:
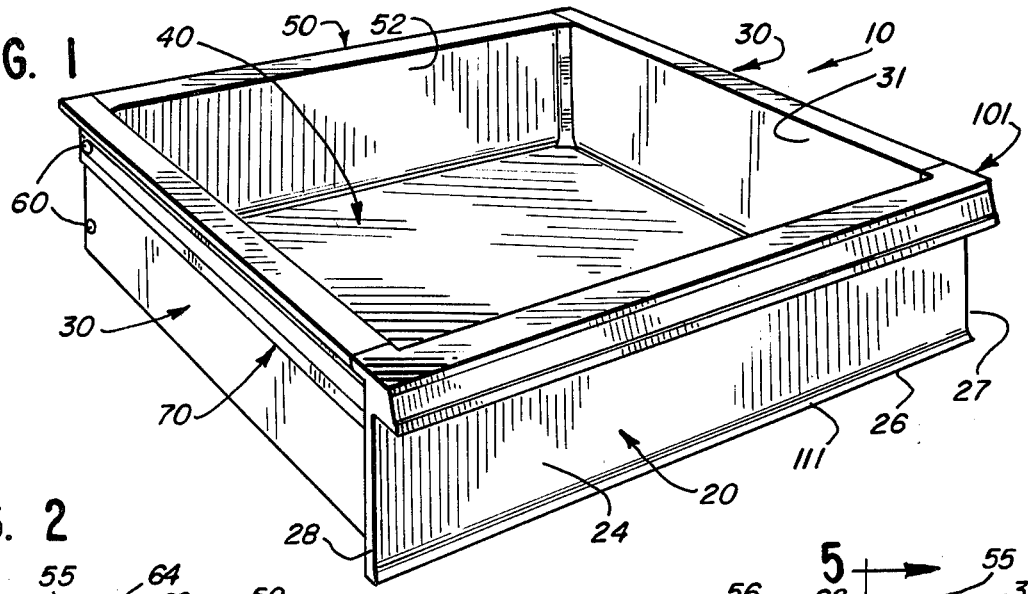
FIG. 1 is a perspective view of the components of the knock-down drawer assembly of the present invention in a fully assembled condition.

While this invention is susceptible of embodiment in different forms, there is shown in the drawings and will herein be described in detail a preferred embodiment of the invention. It will be understood, however, that the present disclosure is to be considered as an exemplification of the principles of the invention and is not intended to limit the invention to the embodiment illustrated.

The precise shapes and sizes of the components herein illustrated are not essential to the apparatus unless otherwise indicated.

It will be understood that the drawer assembly disclosed herein may be mounted in a conventional cabinet, desk, workbench, frame, etc., the details of which, though not fully illustrated or described, will be apparent to those having skill in the art and an understanding of the necessary functions of such conventional mounting structures.

For ease of description, the drawer assembly disclosed herein will be described in the normal operating or use position and terms such as upper, lower, horizontal, etc., will be used with reference to the normal use position. It will be understood, however, that the drawer assembly may be manufactured, stored, transported, and sold in orientations other than the normal use position described.

Referring to the drawings, the novel drawer assembly of the present invention is designated generally by the reference number 10 in FIG. 1. The assembly 10 includes a front panel 20 having an inner face 22 (FIG. 2) and an outer face 24. With reference to FIG. 3, the front panel 20 also has a top margin 25, a bottom margin 26, and two generally vertical end margins 27 and 28. The front panel 20 also defines, along its bottom margin 26 on its inner face 22, a channel 23 extending between its end margins 27 and 28 as best illustrated in FIGS. 4 and 5.

Figure 2:
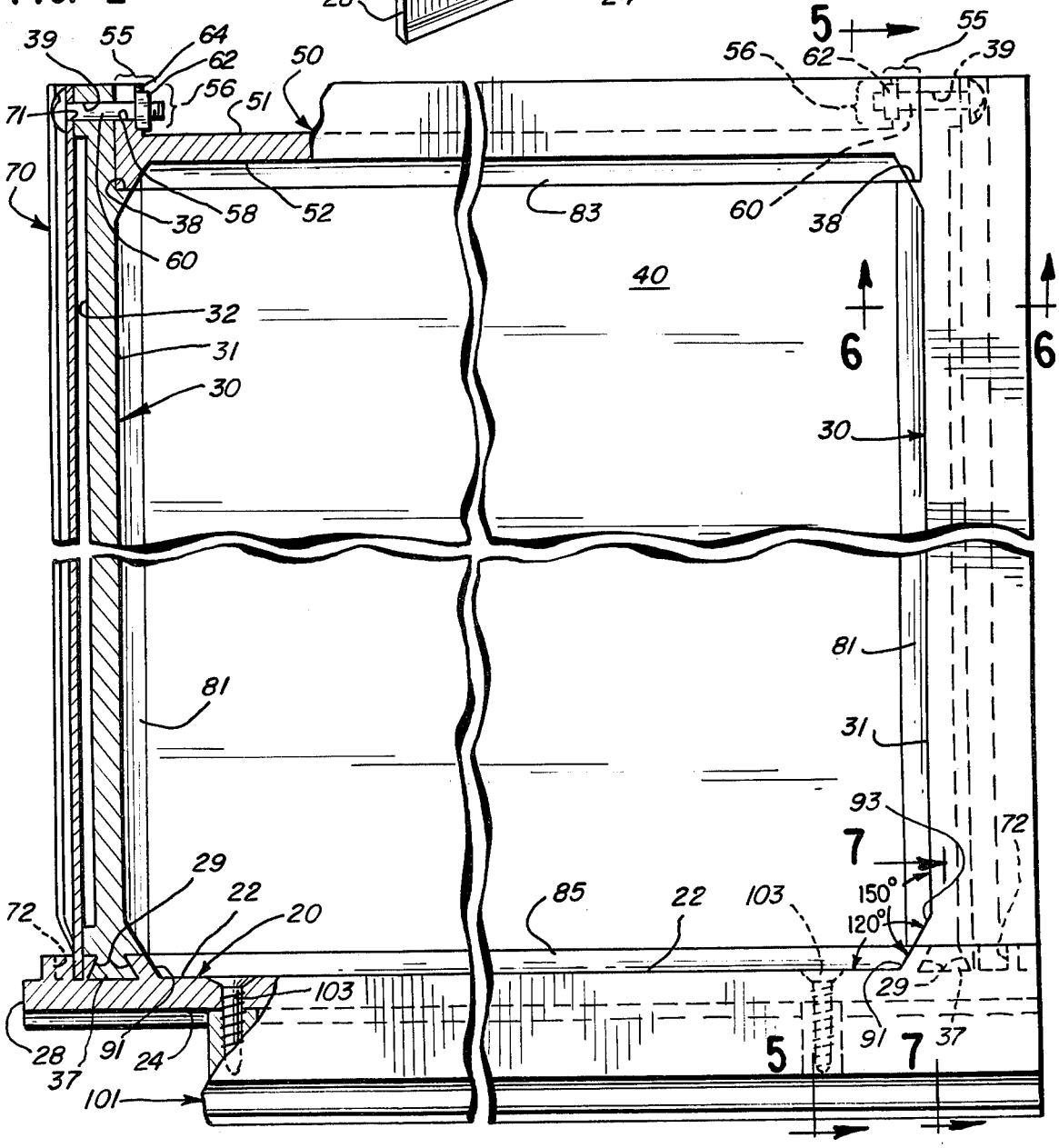
FIG. 2 is a top plan view of the drawer assembly with portions of the structure broken away to illustrate certain interior and cross section detail.
Figure 4:
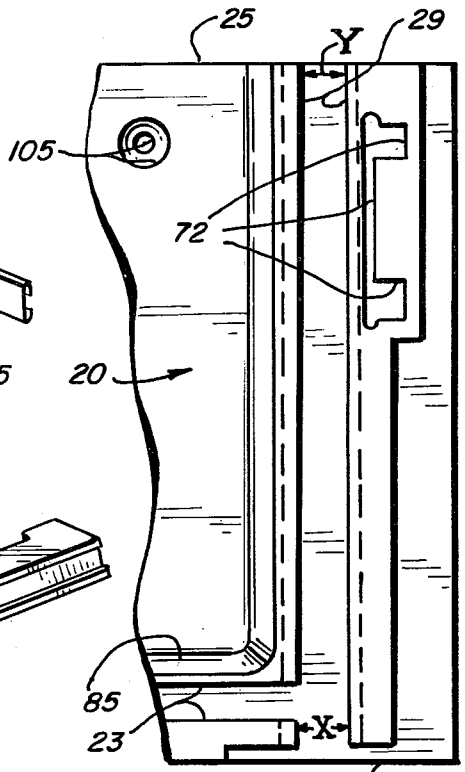
FIG. 4 is a greatly enlarged, fragmentary, side elevation view of the inner face of the drawer assembly front panel taken along the plane 4—4 in FIG. 3.
Figure 3:
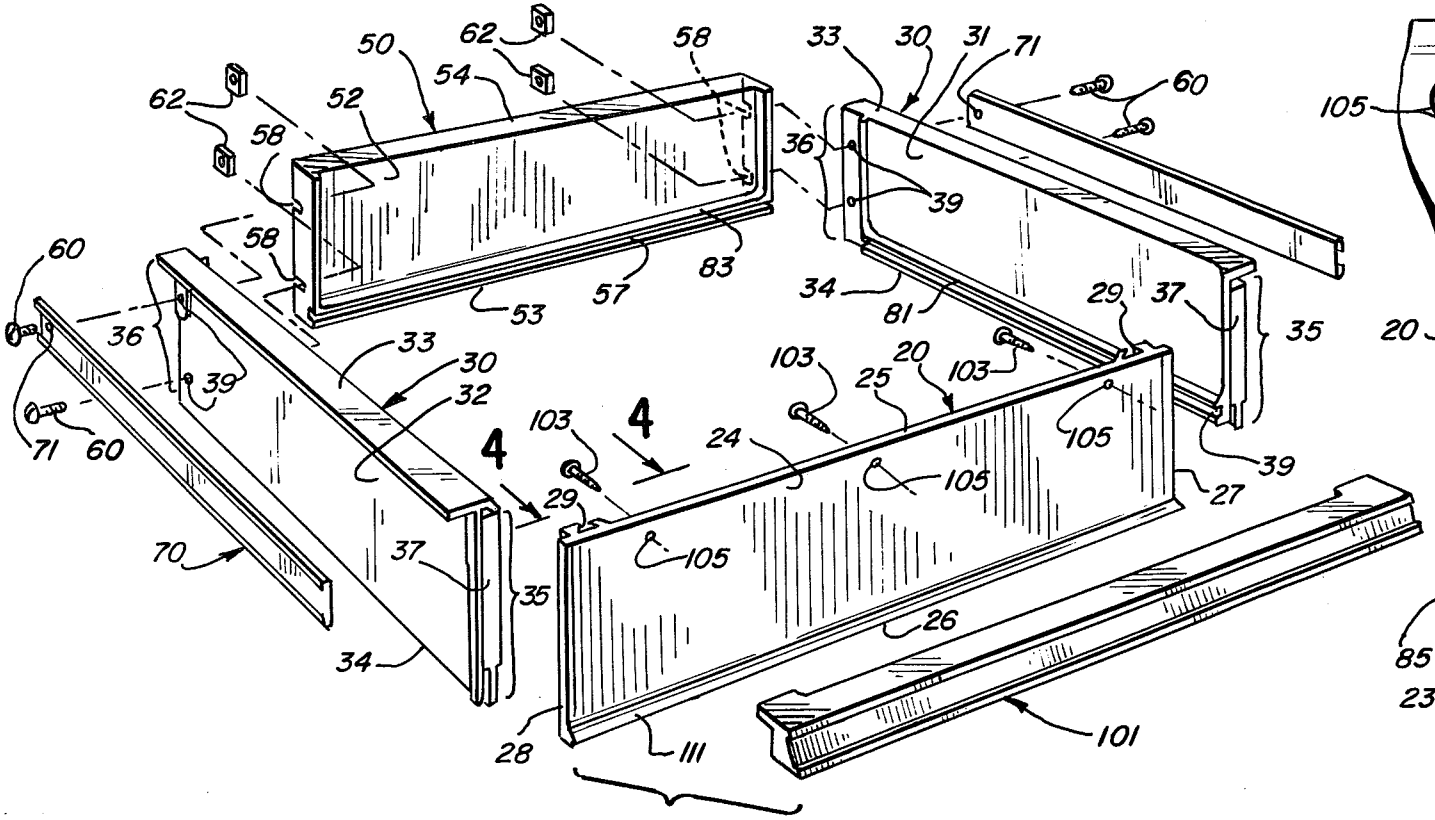
FIG. 3 is an exploded, perspective view of the drawer assembly from the same perspective as in FIG. 1 but with the bottom panel omitted for clarity.

As best illustrated in FIGS. 2 and 4, the front panel 20 defines two generally vertical and parallel dovetail mortises 29 on the front panel inner face 20. One of the mortises 29 is adjacent one of the front panel end margins 28 and the other of the mortises 29 is adjacent the other of the front panel end margins 27. Preferably, the mortises 29 are defined by outwardly projecting portions of the inner face 22.

As best illustrated in FIG. 4, the opposing sides of each mortise 29 are tapered inwardly by a constant angle along the vertical length of the mortise relative to the longitudinal vertical center line of the mortise so as to provide a mortise that is narrower at one end of the mortise than at the other end of the mortise. In particular, the mortise 29 is widest at the bottom margin 26 of the front panel 20 and is narrower at the top margin 25 of the front panel 20. This is indicated by the dimension X in FIG. 4 at the bottom of the mortise 29 and by the smaller dimension Y at the top of the mortise 29.

As best illustrated in FIGS. 1 and 3, a pair of side panels 30 are provided. With reference to FIG. 6, each side panel 30 is seen to have an inner face 31 and an outer face 32. As best illustrated in FIG. 3, each side panel 30 also has a top margin 33 and a bottom margin 34. In addition, each side panel 30 has two generally vertical ends, a front end 35 and a rear end 36, each end extending between the top margin 33 and the bottom margin 34. Each side panel 30 also defines, along its bottom margin 34 on its inner face 31, a channel 39 extending between the side panel ends 35 and 36.

As best illustrated in FIGS. 2 and 3, each side panel 30 has a dovetail tenon 37 on the front end 35. Each tenon 37 is adapted to be received in one of the front panel mortises 29. The sides of each tenon 37 are tapered inwardly along the vertical length of the tenon relative to the vertical longitudinal center line of the tenon. Each tenon 37 is tapered at the same constant angle as the mortise taper angle to provide a tenon that is narrower at one end of the tenon than at the other end of the tenon. In the preferred embodiment, the bottom of the tenon, beginning just above the side panel channel 39, is wider than the top of the tenon adjacent the side panel top margin 33.

The transverse cross section of each tenon 37 at any point along the tenon length is the same size and shape as the transvese cross section of the opening defined by the receiving mortise 29 at any corresponding point along the mortise length so as to locate the side panel 30 at a predetermined vertical placement relative to the front panel 20.

As best illustrated in FIGS. 1, 2, 5, and 6, a horizontal bottom panel 40 is provided to define the bottom of the drawer assembly 10. As best illustrated in FIG. 5, the bottom panel 40 has an outer or downwardly facing surface 45 and an inner or upwardly facing surface 47. With continued reference to FIG. 5, the bottom panel 40 is seen to have a front margin 41 received in the channel 23 of the front panel 20. As best illustrated in FIG. 6, the bottom panel 40 has an end margin 32 on each end which is received in the channel 39 of one of the side panels 30.

As shown in FIGS. 1 and 2, a rear panel 50 is provided with an outer face 51 and an inner face 52. As best illustrated in FIG. 5, the rear panel 50 also has a bottom margin 53 and a top margin 54. With reference to FIG. 2, the rear panel 50 can further be described as having two end margins 55. As best illustrated in FIG. 5, the rear panel 50 also defines, along its bottom margin 53 on its inner face 52, a channel 57 extending between its end margins 55 for receiving a rear margin 49 of the bottom panel 40.

Novel means are provided for securing each end margin 55 of the rear panel 50 to one of the side panels 30 adjacent the side panel rear end 36. Specifically, as best shown in FIG. 2, each side panel 30 defines a rearwardly facing shoulder 38 abutting the front face of an end margin 55 of the rear panel 50. This locates the rear panel 50 along the length of each side panel 30 relative to the front panel 20.

Each side panel 30 also extends rearwardly beyond the shoulder 38 and defines two apertures 39 extending between the inner face 31 and the outer face 32 of the side panel 30. Each end margin 55 of the rear panel 50 has a rearwardly projecting flange 56 (FIGS. 2 and 5) that is parallel to the rearward extension of the side panel 30 defining the side panel apertures 39. The rear panel flange 56 is in face-to-face engagement with this adjacent side panel rearward extension. Each rearwardly projecting flange 56 of the rear panel 50 defines two flange apertures or U-shaped slots 58 as best illustrated in FIGS. 2, 3 and 5. Each flange aperture or slot 58 is in alignment with one of the side panel apertures 39.

A fastener 60 is disposed through each of the side panel apertures 39 and the aligned rear panel flange apertures 58. Each fastener 60 is preferably secured to retain the rear panel 50 against the side panel shoulder 38 with the rear panel flange 56 engaged with the rearward extension of the side panel 30.

Preferably, each fastener 60 has a threaded shank and the retention of the fastener 60 is effected by means of a nut 62 which is threadingly engaged with the threaded shank of each fastener 60. Also, the rear panel 50 preferably defines a counter-sunk cavity 64 (FIGS. 2 and 5) around each aperture 58 for receiving the nut 62 and for restraining the nut 62 against rotation within the cavity 64. This facilitates threading the fastener 60 into the nut 62 to provide a tight connection.

As best illustrated in FIGS. 1–4 and 6, each fastener 60 also functions to secure a conventional track, slide, or guide member 70 to the outer face 32 of each side panel 30. Such tracks 70 are conventionally provided on the sides of a drawer for engaging movable or fixed tracks on the frame of the workbench or other structure (not illustrated) in which the drawer is to be mounted. Typically, the drawer, with the track 70 secured thereto, can be removed from the workbench or other support structure while leaving the fixed and/or movable tracks in the support structure.

As best illustrated in FIG. 4, the inner face of front panel 20 is provided with a suitably shaped cavity 72 for receiving the front end of the track 70 and for retaining the track 70 in position along the side panel 30. At the rear of the drawer assembly 10, each track 70 is secured with one of the fasteners 60 through a suitable aperture 71 in the track.

The drawer assembly 10 is provided with a novel interior surface configuration. Specifically, as best illustrated in FIG. 2, each side panel 30 has an inwardly projecting lip 81, the rear panel 50 has an inwardly projecting lip 83, and the front panel 20 has an inwardly projecting lip 85. As best illustrated for the front panel 20 in FIG. 5, the lip 85 defines the upper portion of the panel channel 23. The lip 85 also defines a concave curvature on the inside of the drawer above the panel channel 23. This provides a relatively smooth contour from the front panel vertical inner face 22 to the upwardly facing horizontal inner face 47 of the bottom panel 40. The lips on the other panels have an identical configuration. Owing to the curvature of each lip, it is easier to remove small, slender articles from the bottom peripheral regions of the interior of the assembled drawer.

The novel inside configuration of the drawer assembly 10 also preferably includes a special vertical corner construction. Specifically, as best illustrated in FIG. 2, the drawer assembly 10 can be regarding as having four principal corners in a generally rectangular configuration. Each principal corner of the drawer assembly 10 can be characterized as being defined by two adjacent panels. with reference to the lower right-hand quarter of the drawing in FIG. 2, the corner is defined by the front panel 20 and by the right-hand side panel 30. Each panel defines a generally vertical extending corner surface—corner surface 91 on the front panel 20 and corner surface 93 on the side panel 30.

The corner surface 91 projects inwardly from the front panel inner surface 22 at a predetermined angle. In FIG. 2, this angle is designated 120° as measured between the inner face 22 and the corner surface 91. In accordance with the preferred form of this invention, the angle measured between the inner face of the panel and the corner surface is between 90° and 180°.

In the adjacent side panel 30, the corner surface 93 projects inwardly from the inner face 31 at the corner of the drawer assembly 10. The corner surface 93 defines an angle, as measured between the inner face 31 and the corner surface 91, of between 90° and 180°. In the specific embodiment illustrated in FIG. 2, the angle of the side panel corner surface 93 is shown as 150°. By appropriate location of the corner surfaces 91 and 93, the corner surfaces 91 and 93 cooperate to define a substantially continuous planar surface at the corner of the drawer assembly 10.

When the corner angles of the corner surfaces are measured as described above, the sum of the corner angles of two adjacent panels is seen to be equal to 270°. Although the corner angles of the corner surfaces 91 and 93 are illustrated in FIG. 2 as being 120° and 150°, respectively, it is to be realized that any other combination of angles between 90° and 180° may be used so long as the sum of the two corner angles equals 270°.

A conventional right-angle corner drawer assembly can be formed if the angle of one corner surface is 90° and the angle of the corner surface of the adjacent panel is 180°. This would provide a 90° corner. Such a conventional right-angle corner has the disadvantage of creating an interior corner structure from which the extraction or removal of small objects may be difficult. On the other hand, when the corner angles of the corner surfaces of adjacent panels are between 90° and 180° as illustrated in FIG. 2, small articles are more easily retrieved from the modified inside "corners." In addition, this interior corner structure facilitates cleaning and dusting of the inside of the drawer assembly 10.

As best illustrated in FIGS. 1, 2, 3, and 5, the front panel 20 may be provided with a handle 101 extending the length of the front panel 20. The handle 101 may be secured with suitable screws 103 extending through apertures 105 (FIGS. 3 and 5) in the front panel 20 and engaged in bores 107 (FIG. 5) of the handle 101.

Finally, if desired, an exterior lip 111 may be provided on the outer face 24 of the panel 20 along the bottom margin 26 as best illustrated in FIGS. 1 and 5. The lip 111 may conveniently function in a cosmetic or aesthetic manner to block observation of the space between the bottom of the drawer assembly 10 and the next lower drawer assembly in a workbench, desk, cabinet, or other structure containing a plurality of such drawer assemblies 10 in a vertically oriented array.

The various above-described components of the drawer assembly 10 are preferably molded or otherwise fabricated by mass production techniques which are facilitated by the component design. For ease of shipping and distribution, and to reduce manufacturing costs, the components of the drawer assembly 10 may be transported to the retail sales point or to the ultimate user in the "knocked-down" (not assembled) configuration. The user can conveniently and easily assemble the components to form the drawer illustrated in FIG. 1.

Specifically, the two side panels 30 are first inserted into the front panel 20 from the bottom of the front panel 20. The insertion movement of the side panels 30 is ultimately terminated because of the engagement of the tapering tenons 37 with the tapering mortises 29. After the tenons 37 have fully engaged the walls of the mortises 29, the side panels 30 cannot be moved further towards the top of the drawer. At this point in the assembly of the preferred embodiment illustrated in FIG. 5, the side panel bottom margins 34 are even with the front panel bottom margin 26. Also, the side panel channels 39 (FIG. 6) are aligned at the same elevation as the front panel channel 23 (FIG. 5).

Next, the bottom panel 40 is inserted from the rear into the side panel channels 39 and into the front panel channel 23.

Then, the rear panel 50 is positioned to receive the bottom panel 40 in the rear panel channel 57 as best illustrated in FIG. 5. In addition, at each end margin 55 of the rear panel 50, the rear panel 50 is positioned against the rearwardly facing shoulders 38 of a side panels 30. Further, the rearwardly extending flange 56 at each end margin of the rear panel 50 is positioned parallel to, and in face-to-face engagement with, the portion of the adjacent side panel that extends rearwardly of the shoulder 38.

Next, the metal track 70 is properly positioned along each side panel 30. In particular, the front end of each metal track 70 is disposed within the front panel receiving cavity 72 (FIG. 4). Then, the threaded fasteners 60 are secured at the rear of the drawer assembly 10. Specifically, the upper fastener 60 on each side of the drawer is disposed through a suitable aperture 71 in the track 70, through the side panel aperture 39, and through the aligned rear panel flange aperture 58. The lower fasteners 60 are similarly mounted in the side and rear panels except, of course, that they are not passed through the track 70. All of the fasteners are threadingly engaged with nuts 64 to provide a tight joint.

Finally, the handle 101 may be mounted to the front face 24 of the front panel 20 with the three screws 103 as best illustrated in FIGS. 3 and 5.

It will readily be observed from the foregoing detailed description of the invention and of the illustrative embodiment thereof that numerous variations and modifications may be effected without departing from the true spirit and scope of the novel concept of the principles of this invention.

What is claimed is:

1. A knock-down drawer assembly comprising:

a front panel having an outer face and an inner face, said front panel having a top margin, a bottom margin, and two generally vertical end margins, said front panel defining along its bottom margin on its inner face a channel extending between its end margins, said front panel defining two generally vertical and parallel dovetail mortises on said front panel inner face, one of said mortises being adjacent one of said front panel end margins and one of said mortises being adjacent the other of said front panel end margins;

a pair of side panels each having an inner face and an outer face, each said side panel having a top margin and a bottom margin, each said side panel having two generally vertical ends extending between said top and bottom margins, each said side panel defining along its bottom margin on its inner face a channel extending between said side panel ends, each said side panel having a dovetail tenon on one end of said side panel, each said tenon being adapted to be received in one of said front panel mortises;

a horizontal bottom panel having a front margin, a rear margin, and two parallel end margins, said bottom panel having an inner face and an outer face, said bottom panel front margin being adapted for being received in said channel of said front panel, one of said bottom panel end margins being adapted for being received in the channel of one of said side panels, the other of said bottom panel end margins being adapted for being received in the channel of the other of said side panels;

a rear panel having an outer face and an inner face, said rear panel having a top margin, a bottom margin, and two end margins, said rear panel defining along its bottom margin on its inner face a channel extending between its end margins and adapted for receiving said rear margin of said bottom panel;

means for securing each end margin of said rear panel to one of said side panels adjacent one of said ends of said side panel;

each said side panel defining a rearwardly facing shoulder for abutting one of said end margins of said rear panel to locate said rear panel along the length of the side panel relative to said front panel;

each said side panel extending rearwardly beyond said shoulder and defines a side panel aperture extending between the inner and outer faces of the side panel;

each said end margin of said rear panel having a rearwardly projecting flange that is adapted to be positioned parallel to said rearward extension of one of said side panels and that is adapted to be positioned in face-to-face engagement with the one side panel rearward extension, each said rear panel rearwardly projecting flange defining a flange aperture for alignment with one of said side panel apertures; and said securing means including a fastener adapted to be disposed through one of said side panel apertures and an aligned rear panel flange aperture for being secured to retain said rear panel against said said side panel shoulder with said rear panel flange engaged with said rearward extension of said side panel.

2. The assembly in accordance with claim 1 in which said rear panel flange defines a cavity around said flange aperture;

in which said securing means includes a nut for being disposed in said cavity and restrained against rotation; and in which said fastener has a threaded shank for being threadingly engaged with said nut.

* * * * *